United States Patent [19]

Bauer

[11] 4,260,4

[45] Apr. 7, 19

[54] REMOVAL OF PARTICULATES FROM PYROLYTIC OIL

[75] Inventor: Hans F. Bauer, Dana Point, Calif.

[73] Assignee: Occidental Research Corporation, Irvine, Calif.

[21] Appl. No.: 35,722

[22] Filed: May 3, 1979

[51] Int. Cl.[3] ..... C10G 1/02

[52] U.S. Cl. ..... 208/14; 208/8 R; 201/2.5; 201/25; 201/29; 201/30; 585/240

[58] Field of Search ..... 201/25, 2.5, 28, 29, 201/30; 208/8 R, 97, 308, 350, 14; 585/240

[56] References Cited

U.S. PATENT DOCUMENTS

| | | | |
|---|---|---|---|
| 1,864,855 | 6/1932 | Pier et al. | 208/8 R |
| 1,904,521 | 4/1933 | Pier et al. | 208/8 R |
| 3,240,566 | 3/1966 | Bullough et al. . | |
| 3,843,457 | 10/1974 | Grannen et al. | 201/2.5 |
| 3,853,498 | 12/1974 | Bailie | 48/209 |
| 3,954,596 | 5/1976 | Schroeder | 208/10 |
| 3,960,701 | 6/1976 | Schroeder | 208/8 |
| 4,013,516 | 3/1977 | Greenfield et al. | 201/2.5 |
| 4,085,030 | 4/1978 | Green et al. | 208/ |
| 4,150,548 | 4/1979 | Kemp et al. | 201, |

*Primary Examiner*—Wilbur L. Bascomb, Jr.
*Attorney, Agent, or Firm*—Christie, Parker & Hale

[57] ABSTRACT

A process for producing organic liquid product fr solid organic waste. The process comprises pyrolyzi the solid organic waste to produce pyrolysis vapors a solid pyrolysis residue. The solid residue is separat from the pyrolysis vapors leaving entrained particul matter in the vapor. At least a portion of the pyroly vapor is condensed for producing pyrolysis liquid cc taining entrained particulate matter. The pyrolysis l uid is centrifuged producing a light fraction contai entrained particulate matter, a middle fraction subst tially free of particulate matter and a heavy fracti containing entrained particulate matter. The midc fraction is recovered as organic liquid product subst tially free of entrained particulate matter. The lig fraction and heavy fraction are mixed and filtered. T liquid filtrate produced is distilled for producing ad tional organic liquid product.

17 Claims, 1 Drawing Figure

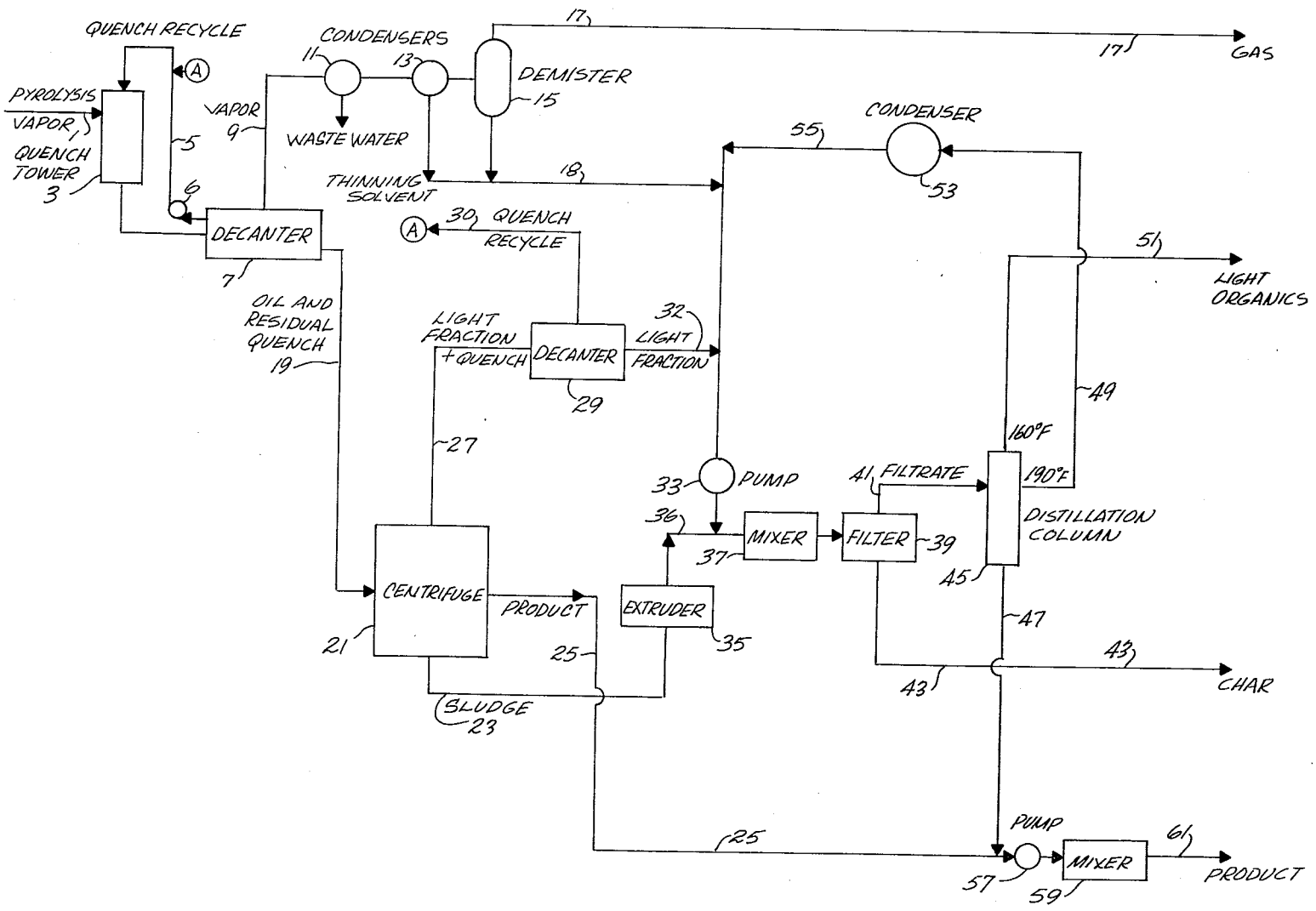
GAS
LIGHT ORGANICS
CHAR
PRODUCT
DISTILLATION COLUMN
160°F
190°F
CONDENSER
FILTRATE
FILTER
MIXER
PUMP
EXTRUDER
DEMISTER
CONDENSERS
WASTE WATER
THINNING SOLVENT
QUENCH RECYCLE
DECANTER
LIGHT FRACTION
+QUENCH
CENTRIFUGE
SLUDGE
OIL AND RESIDUAL QUENCH
VAPOR
QUENCH RECYCLE
PYROLYSIS VAPOR
QUENCH TOWER

REMOVAL OF PARTICULATES FROM PYROLYTIC OIL

BACKGROUND OF THE INVENTION

The disposal of industrial and domestic solids, such as trash, rubbish, garbage, etc. is an ever increasing problem which has given rise to immense national concern. The costs of disposal of solid wastes ranks third behind public schooling and highway construction and maintenance as a governmental expense in the United States. The cost per unit of solid waste disposal and the number of units of solid waste per person are rising annually. It is estimated that each individual in the United States generates about four to six pounds of solid waste per day, and that the industrial output of solid waste is equivalent to an additional five to ten pounds per person per day. The average cost of disposal of solid waste varies from about five dollars ($5) to about thirty dollars ($30) per ton. Previous methods of solid waste disposal such as the use of landfills and incineration are becoming prohibitively expensive and difficult to operate because of government regulations and guidelines regarding environmental pollution and the health hazards presented by operation of such disposal methods.

A second aspect of the solid waste disposal dilemna is that the United States is consuming its natural resources at an ever increasing rate. In the normal materials utilization cycle, raw materials are collected, processed into useful products, utilized by consumers for varying spans of time, and then consigned to a presumably unrecoverable wasteland, the city dump.

In view of these problems, many proposals have been put forth to utilize and recover values from solid wastes. Aluminum companies, paper companies and glass companies reclaim and recycle used cans, papers and bottles for reprocessing. Engineering studies and plant designs have been prepared to advance the concept of utilizing heat produced by garbage incineration to operate electrical and desalination plants.

The idea of recovering metal values from solid wastes is old in the art and has played an integral part of the steel production industry. However, processes need to be developed which utilize both the metallic and nonmetallic portion of solid wastes as a recoverable material since these portions represent a large fraction of the solid wastes. Simple incineration of the organic portion of solid wastes to produce utilizable heat does not appear to be the solution. Off gases produced during incineration contain air pollutants such as $SO_2$, $NO_x$, CO and ash. To avoid air pollution, these pollutants must be trapped or diminished which requires costly devices such as electro-static precipitators, scrubbers and the like. In addition, organic solid wastes are a poor fuel and typically require very high combustion temperatures. What is needed is an efficient, economical method for handling solid wastes produced by society which can recover chemical and fuel values from both the inorganic and organic portions while substantially reducing the volume of gaseous effluent which must be treated to eliminate air pollution during processing.

Processes currently being used in reclaiming fuel and chemical values from waste material generally begin with pyrolysis of such waste material. A primary problem present in the current pyrolysis processes in the production of solids within the products. Generally, during pyrolysis, an inert carrier gas is used and very fine particles are unavoidably passed through the conventional solids/gas separation units, such as cyclone used to stop most of the solids. The solids arise gene ally from three sources: inorganic particulates that a not removed by air classification, solids left behind t volatilizing material quickly, and solids formed fro the vapor state by decomposition of vapors. Some the retained solids contain metals which can dissolve the pyrolytic oil produced by the process to give soluble ash content. Generally, it is desired to reduc and minimize the ash content in the pyrolytic oil. Ge erally, the solids retained are not soluble, that is, do n provide a soluble ash content because most of the oi are not good solvents for metal ions.

It is important to remove the solids entrained in tl pyrolysis vapors and which are not stopped by tl conventional solids/gas separation units for sever reasons. Solids remaining in pyrolytic oil can cau abrasion of transfer lines and can plug nozzles or oth units within a liquid or solids transfer system. Additio ally, solids containing ash raise the total ash and partic late emissions when the pyrolytic oil is burned for co sumption as a fuel. The solids can also increase viscosit of the pyrolytic oil especially if such solids are finel divided. Prior methods of solids removal from pyrolyt oils using either filtration or centrifugation have n been successful in solving the solids removal proble effectively. For example, gravity filtration throug even the coarsest (or fast) filter paper is generally n successful. Filtration with suction applied to a pap filter on a Buchner funnel is somewhat better, but tl paper generally becomes clogged with an insoluble gu within a short period of time. Generally, filtration t remove solids occurs best with a coarse glass frit usin a pressure differential across the glass frit. However, tl glass frit tends to plug with tars present in the pyrolyt oils.

To increase the viscosity and throughput through filter, the temperature of pyrolytic oil has been i creased to raise the viscosity of the oil. A drawback increasing the temperature is the loss of the light mat rial in the oil because of the elevated temperatures an suction during filtration. The removal of the light enc results in fractionation of the pyrolytic oils and a co comitant increase in the viscosity of the remaining oi Therefore, an improvement in the solids separatio without involving a final hot vacuum filtration is desi able to retain the inherent fluidity of the oil while redu ing the solids content.

SUMMARY OF THE INVENTION

According to the present invention there is provide a process and apparatus for the treatment of solid wast for recovery of values contained therein for recyc back to the economy. The process relates to the pyrol sis of carbonaceous materials for forming a pyrolytic o and the subsequent separation of solids entrained in tl pyrolytic oil.

In the pyrolysis process, the substantially organi fraction of a mixture of solid wastes is dried and comm nuted to a particle size less than about five mesh an preferably less than about 8 mesh. This organic fractio is subjected to flash pyrolysis. The flash pyrolysis co sists of an operation wherein the dried, comminute substantially organic fraction is combined with a parti ulate solid source of heat and a carrier gas which nonreactive or non-deleteriously reactive with respe to the product of pyrolysis under turbulent flow cond ions in a flash pyrolysis zone maintained at a temperature from about 600° to about 2000° F. by the flow of he solid particulate source of heat therethrough. Car-on-containing solid residue of pyrolysis, gases and ondensable pyrolytic oils are formed as the pyrolysis roducts.

The pyrolytic vapors produced in the flash pyrolysis ontain solids which solids arise from inorganic particuates, solids left behind by volatilizing material quickly, nd solids formed from the vapor state by decomposi-ion of vapors. A pyrolysis oil is produced by rapidly ondensing at least a portion of the pyrolysis vapor. During this rapid condensation, some of the solid particulate entrained in the vapor becomes entrained in the yrolytic oil. The pyrolytic oil containing entrained olid particulate matter is centrifuged to produce a light raction containing particulate matter, a middle fraction ubstantially free of particulate matter and a heavy raction containing particulate matter. The middle fracion is an organic liquid which is substantially free of olid particulate matter. The composition of the pyroytic oil obtained in the middle fraction is generally nade up of hundreds of organic compounds varying in nolecular weight from about 32 to about 10,000 or reater, with boiling points ranging from about 55° C. o greater than 360° C. About one-half of the liquid naterial is not capable of being distilled. Some of the rganic compounds which comprise the middle fraction re oxygenated organic compounds having a carbon-to-xygen ratio generally ranging between about one and wo.

The light fraction and the heavy fraction produced pon centrifugation of the pyrolytic oil condensed from he pyrolysis vapor are combined to form a mixture ontaining entrained particulate matter. The entrained olid particulate matter within the mixture can be separated from the mixture such as by filtering the mixture. Jpon filtering, there is produced a liquid filtrate and a olid residue retained as a filter cake. The liquid filtrate an be treated for recovery of values contained therein. uch liquid filtrate can be distilled into at least one ower boiling fraction and at least one higher boiling raction.

During distillation of the mixture, any light organics aving low boiling points can be recovered as a light rganic product. The lower boiling fraction produced pon distillation of the mixture can be recovered as a ower boiling organic product. The higher boiling fracon can be condensed and recycled as a diluent for iluting the mixture of light fraction and heavy fraction roduced by centrifugation of the pyrolytic oil. Recyling such a higher boiling fraction as a diluent enances filtration of the mixture as the viscosity of the nixture is lowered due to the dilution.

The highest boiling fraction produced upon distillaon or the filtrate remaining a liquid after separation of ne higher boiling fraction can be recovered as organic quid product.

The solids separated from the mixture of light and eavy fractions resulting from the centrifugation can be eclaimed as char. Such char can have utility within the rocess as a portion of the solid source of heat used in ne pyrolysis step.

BRIEF DESCRIPTION OF THE DRAWING

The accompanying drawing illustrates a schematic utline and arrangement of equipment for carrying out ne process of this invention.

DETAILED DESCRIPTION OF THE INVENTION

The process herein is a treatment process for solid wastes containing organic matter which are produced in our society. The solid wastes are treated to produce and recover valuable products from such solid organic waste matter. Muncipal solid wastes can contain a wide variety of components, i.e., glass, metal, water, organic products such as paper, natural and synthetic rubber, plastics, vegetable and animal material, sludge, etc. Industrial and agricultural wastes include such waste as rubber, plastics, manure, waste wood products, cannery wastes, tree bark, rice hulls, etc. The process herein treats such municipal, industrial and agricultural wastes by pyrolysis for conversion and/or volatilization of the organic material in the solid wastes to useful organic chemicals and fuel values, such as hydrocarbons, oxygenated hydrocarbons and the like. Although the proces herein can be used in the treatment of conventional solid wastes without prior segregation of the organic matter therefrom, the inorganic materials are preferably segregated from the solid wastes and only that portion of the solid wastes which is composed substantially of organic (carbonaceous) materials or matter is treated by the present process. The degree of segregation of organic matter from the original solid wastes is variable as total segregation can impose uneconomical cost factors on the overall process.

Solid wastes can be segregated by using conventional separation equipment and processes. The presence of water in the organic wastes is preferably kept to a low value (from about zero to about five percent) since the presence of water creates an aqueous fraction in the volatiles recovered in the process and imposes an extra heat load during the pyrolysis step. The aqueous fraction contains organic solvents such as alcohols, ketones, aldehydes and acids, which create an additional separation problem upon recovery. Large quantities of water can be removed from the solid wastes by techniques known in the art such as by heating in a predrying process. Solid wastes, segregated or unsegregated, are comminuted to a particulate size wherein the maximum dimension of the particles is no greater than about one inch. Preferably, the size of the particles of the comminuted waste have a maximum dimension of about 0.25 inch or less. Especially preferred is a feed of comminuted particles having a particle size of minus 28 mesh. By the term "maximum dimension" is meant the largest dimension, i.e., either length or width or thickness, of the individual particles which should not exceed this upper limit. The individual particles can have smaller dimensions and can consist of particles having essentially three dimensions; particles having essentially two dimensions, e.g., pieces of paper, plastic film, plant leaves, etc.; and particles having essentially one dimension, e.g., organic filaments. The size and shape of the particles, as well as the density, can affect the pressure drop within the system and the heat transfer to the particles. Any changes in size can, therefore, necessitate adjustments of residence times within the pyrolysis zone to insure that the particles of organic matter are heated to the desired reaction temperature in the pyrolysis zone. For this reason it is preferable that the solid wastes be comminuted and intermixed to produce a substantially uniform mixture. Particle sizes greater than about 0.25 inch do not provide the high rate of heat transfer which is essential to the operation of the pyrolysis process. Since a char product is produced by the process, the resulting char particles also have a particle size of less than about 0.25 inch.

In the process, pyrolysis is conducted by heating the organic solid wastes to a temperature ranging from between about 300° F. to about 2000° F., preferably from about 600° F. to about 1000° F. To accomplish pyrolysis in the process herein, it is desirable that a very rapid heating rate be used, such as from about 100° to about 2000° F. per second. An especially preferred heating rate is from about 800° F./per second to about 1000° F./per second. During pyrolysis the solid wastes are entrained in a turbulent gaseous stream composed of carrier gas, waste solids and hot particulate char. The stream is contained within a pyrolysis zone for a period of less than ten seconds and preferably from about 0.1 to about 2.0 seconds. In general, organic solid wastes from municipal sources can be advantageously treated by the process of heating the organic solid wastes to a temperature ranging from between about 800° F. to about 1000° F. in the pyrolysis zone with a residence time ranging between about 0.1 to about 2 seconds. When the process is conducted so that the organic solids are heated to a temperature of about 900° F. in the pyrolysis zone, a residence time of from about 0.3 seconds to about 1.3 seconds is preferred. When the particulate waste is composed of natural and synthetic rubber, such as automobile tires, a temperature of about 600° F. to about 2000° F. can be employed. The relationship between temperature and residence time can be varied to optimize yields of pyrolysis vapor and fuel values. If the temperature and/or residence times are too low, the vaporization and pyrolysis of solid waste is incomplete. When the temperature and/or residence time is too high, the pyrolysis products are degraded producing low yields of products and fuel values.

By the term "turbulent stream" is meant a stream of gas flowing through a pyrolysis zone, e.g., a pipe-shaped reactor vessel wherein the flow is turbulent in nature, e.g., having a Reynolds flow index number greater than 2000 and preferably about 2500. In operation, a low ratio of about 0.2 to about 2.0 pounds of mixed gases to each pound of solid wastes is all that is required to obtain the Reynolds flow index number of 2000 or greater when the pyrolysis chamber has a diameter of three inches or greater. For example, with a ten inch diameter chamber, about 0.7 pounds of gas for each pound of solid waste is all that is required to maintain a turbulent flow in the chamber. Laminar flow in the pyrolysis zone is to be avoided because such a flow system tends to severely limit the productivity and rate of heat transfer in the pyrolysis zone.

In the normal practice of this invention, the carrier gas, hot char and solid wastes are introduced into one end of a pyrolysis vessel and rapidly intermixed, dynamically contacted with each other and blown through the vessel to permit the requisite heat transfer to occur. The heat required to pyrolyze the organic matter and remove the volatile chemical values can be provided all or in part from the sensible heat in the char particles. Preferably, all of the heat is supplied by hot char. From about 2 pounds to about 12 pounds of hot char is used for each pound of solid waste. The use of hot char as the heat source in the pyrolytic zone has many advantages. Because of the heat capacity and density of the hot char, a much lower volume of char is needed to heat the solid waste than would be the case if only a hot carrier gas were used. The hot char comes in intimate contact with the solid waste in the turbulent gaseous stream for ef cient heat transfer.

The carrier gases found useful in the process to effe tuate the thermal elusion of chemical and fuel valu from the solid waste particles should be nonreacti with the char, organic matter and organic chemic values formed during pyrolysis. This gas stream shou be substantially free of air, oxygen and the like. That the stream should contain less than about four perce oxygen and preferably less than about one percent ox gen by weight. The amount of oxygen is minimized reduce oxidation of organic values including the liqu chemical and fuel values. Exemplary of gases suitab for use as carrier gases are nitrogen, argon, methan hydrogen, carbon monoxide, flue gases, carbon dioxic and any other gas which does not deleteriously rea with or oxidize the organic portion of the matter with the system. In a preferred embodiment, the carrier gas recycled back to the pyrolysis zone after the organ chemical values are removed therefrom.

Preferably, from about one-eighth to about one-sixt pounds of carrier gas are used for each pound of soli particles (solid waste and char) passed through the p rolysis zone, although other ratios can be used as d scribed above.

The effluent from the pyrolysis zone is composed char, volatilized organic fuel and chemical value water (as steam), product gas and carrier gas. The vol tilized organic fuel and chemical values are cooled to temperature below the temperature of pyrolysis to min mize degradation of the organic chemical values. Th solids can be substantially separated from the pyrolys vapor by any conventional solids/gas separator, such a cyclone and the like. When the solid waste passe through the pyrolysis zone contains inorganic matte such as metal and glass particles intermixed with th char produced by the organic portion of the soli wastes, the organic and inorganic solids can be readil separated by conventional air classification system The pyrolysis of the organic solids increases the densit differential between the organic and inorganic solic and actually facilitates their separation. However, th solids containing both inorganic and organic solids ca be recycled through the pyrolysis zone as a solid sourc of heat without prior separation of solids. When th pyrolyzed solids are separated, the latent heat found i the inorganic solids is utilized to provide heat for th pyrolysis zone in order to increase the efficiency an economics of the system, e.g., the heat of the inorgani solids can be used to heat the recycled gases. Altern tively, the inorganic solids can be separated from th char by conventional means if desired. Of course, as obvious to those skilled in the art, the hot inorgan solids recovered are in an excellent form and conditic for further processing by conventional processes t recover metallic or inorganic chemical values ther from.

After the initial gas/solids separation such as in cyclone separator, the gas stream separated generall contains entrained solid particulate matter. The g stream entrains such solid particulate matter because the fine size of the solid particles present in the pyrolys zone. The solids entrained in the pyrolytic vapors ari from inorganic particulates, char produced by volatili ing organic material quickly and solids formed from th vapor state by decomposition of vapors. Even wi efficient gas/solids separation units such as efficie cyclones, there can be retained about two percent solic n the gaseous stream. It is desirable to remove such ntrained solids from the pyrolysis product stream as uch solids can deleteriously effect subsequent processng steps.

The process for treating the pyrolysis vapor after ndergoing an initial gas/solids separation, such as in a yclone separator, is discussed hereinafter with regard o the accompanying drawing. With reference to the rawing, a pyrolysis vapor stream 1 recovered from an nitial gas/solids separator is quenched in a quench ower 3. The pyrolysis vapor stream 1 is generally of a igh temperature and it is preferred to cool the vapor tream to minimize degradation of the organic chemical alues contained in such stream. Cooling of the pyrolyis vapor stream is initially conducted by quenching the yrolysis vapor stream 1 in quench tower 3 utilizing as quenching fluid a suitably immiscible fluid. In the case f municipal solid wastes a No. 2 fuel oil is useful as a uench fluid because of its immiscibility with the pyrolsis vapor and resulting pyrolysis liquid. After admixing f the quenching fluid with the pyrolysis vapor and owering of the temperature of the pyrolysis vapor, the uench fluid is separated from the pyrolysis products in ecanter 7. The separated quench fluid can be recycled rom decanter 7 by pump means 6 for recycling such uench liquid through recycle stream 5 to the quench ower 3.

Upon quenching the pyrolysis vapor at least a portion f the pyrolysis vapor is condensed producing a pyrolyis liquid containing entrained particulate matter. The oncondensing pyrolysis vapor can be recovered from ecanter 7 via vapor line 9. The noncondensing vapor lowing through line 9 can be condensed in a first conenser 11 or in a second condenser 13.

A first condenser 11 can condense the vapor in vapor ne 9 to produce a liquid condensate. For example, such first condenser 11 can recover water, present as steam n the pyrolysis vapor in vapor line 9. The effluent apor from the first condenser 11 can be transferred to second condenser 13. In the second condenser the apor can be condensed to produce a lower boiling quid condensate. For example, a first condenser 11 can e utilized to recover products having a boiling point elow 145° to 155° F. A condensate formed in such a rst condenser can comprise essentially water which as initially present as steam in the vapor. In such a econd condenser 13, the temperature can be between 5° and 105° F. to condense a substantial portion of the emaining vapor for recovery of products within the apor boiling above the range of 95° to 105° F. The apor remaining uncondensed after having passed rough the condensers can be transferred to a demister 5 wherein entrained liquid is separated from the vapor hase. After separation of entrained liquid from the apor the resultant substantially dry gas is recovered rough gas line 17. Such a recovered gas can be a low oiling hydrocarbon gas which can be used for its fuel alue.

The condensate from such second condenser 13 can e used as a thinning solvent as illustrated by line 18 in later step of the process. Additionally, liquid removed om the vapor in the demister 15 can be added to the inning solvent in line 18 for use as a thinning solvent s discussed hereinafter below.

The liquid recovered from decanter 7 is transferred to centrifuge 21 through line 19. The liquid comprises ssentially condensed pyrolysis vapor, solid particulate atter and residual quench liquid. In centrifuge 21, the pyrolysis liquid is centrifuged into three components. Such centrifugation can occur as is shown in the drawing in one centrifuge or can occur in two sequential centrifuges (not shown). The three components formed upon centrifugation comprise a light fraction containing entrained solid particulate matter, a middle fraction substantially free of particulate matter and a heavy fraction containing entrained solid particulate matter. Such a middle fraction can be recovered as an organic liquid product of the pyrolysis of solid wastes. The middle fraction is substantially free of entrained solid particulate matter and therefore, can be readily utilized in subsequent processes for the values contained in such middle fraction. The middle fraction is shown as being recovered through line 25.

The light fraction separated upon centrifugation in centrifuge 21 is recovered from the centrifuge via line 27. The light fraction contains entrained solid particulate matter. The light fraction is mixed with the heavy fraction. Alternatively to mixing the light fraction with the heavy fraction, the light fraction can be separated into two portions of differing solids content. A first liquid portion containing relatively lower amount of solid particulate can be separated from the light fraction in a decanter 29. A second liquid portion containing a relatively greater amount of solid particulate than the first portion and separated in the decanter 29 can be recycled as a quench fluid via line 30 to the quench tower 3. Recycling such a quench fluid through line 30 reduces the amount of extraneous quenching fluid required in the overall process and allows for recovery of values contained in the quench fluid recycled through line 30.

The first portion of the light fraction separated in decanter 29 can be fed through line 32 via pump 33 and and combined with stream 36 from extruder 35 and fed to mixer 37.

The heavy fraction containing entrained solid particulate matter produced in the centrifuge 21 is removed from the centrifuge via line 23 and fed into an extruder 35. The heavy fraction contains a substantial quantity of solid particulate matter and is gritty and sludge-like in appearance. The heavy fraction is passed through extruder 35 to break up the sludge-like quality of the stream. From the extruder 35 the heavy fraction is pumped through line 36 to a mixer 37. In the mixer 37 the heavy fraction can be combined with the light fraction or the first portion of the light fraction from stream 32 produced in the decanter 29.

The liquid recovered from the second condenser 13 can also be introduced into the mixer 37 through pump 33 as shown by line 18. It is beneficial to combine the first portion of light fraction from decanter 29 and the liquid thinning solvent from the second condenser 13 to the heavy fraction in line 36 in order to dilute the heavy fraction and to assist in reclaiming additional fuel values from such heavy and light fractions. The liquid thinning solvent from the second condenser 13, the first portion of light fraction from decanter 29 and the heavy fraction from extruder 35 are thoroughly intermixed in mixer 37.

From the mixer 37 the mixture is transferred to a filter 39. In filter 39 the liquid is separated from the solids entrained in the mixture. The separated solids are recovered from the filter by line 43 and can be recycled to a pyrolysis zone as char and as a potential solid source of heat material for the pyrolysis zone. The liquid filtrate separated in the filter 39 is recovered from the filter through line 41. The liquid filtrate which is substantially solids free is introduced into a distillation column 45. In the distillation column the liquid filtrate can be distilled to produce products of value. For example, at least one low boiling fraction having a boiling point up to about 160° F. can be recovered comprising essentially light organic compounds. At least one higher boiling fraction recovered and having a boiling point up to about 190° F. can be recycled through line 49 to condenser 53 for liquefying such higher boiling fraction. The liquid from the condenser 53 can be recycled by line 55 through pump 33 as additional thinning liquid for the heavy fraction recovered from the centrifuge 21.

The bulk of the material recovered from the distillation column 45 remains essentially liquid in nature generally having a boiling point greater than 190° F., can be recovered through line 47 and combined with the middle fraction recovered from the centrifuge 21. The two liquid streams in lines 47 and 25 can be pumped through pump 57 to a mixer 59 for thoroughly intermixing the two streams. The resultant mixture is a carbonaceous liquid which can be further processed for recovery of fuel values or chemical values contained therein. Such liquid product from the mixer 59 is of value as it is substantially solids free.

As described above, the solid wastes that can be employed in the present process includes municipal garbage, industrial waste, such as tree bark, scrap rubber, rubber grindings, old tire rubber, ground tire carcasses, sugar refinery wastes, corn cobs, rice hulls, animal matter from slaughter houses or rendering plants, sawdust, and the oily discharge obtained from ships when they clean their tanks. Municipal wastes and wastes from vegetable or plant raw materials contain more than 70 percent cellulose base material and produce a characteristic oil when employed in the present process. For example, generally municipal wastes contain from about 70 to about 90 percent cellulose material.

EXAMPLE I

A solid municipal waste comprising about at least 70 percent cellulose material is pyrolyzed in a pyrolysis zone at about 950° F. Prior to introducing the solid municipal wastes to the pyrolysis zone, substantially all of the metal, glass and other inert materials and about 50 percent of the paper fibers were removed. The remaining, primarily organic residue of this municipal solid waste is continuously fed into a pyrolysis reactor at a rate of about three pounds per hour. The particle size of the solid wastes ranges from about 50 mesh to ½ inch.

The pyrolysis vapors produced during the pyrolysis of the solid municipal wastes is introduced to a cyclone separator wherein the solids entrained in the pyrolysis vapors are separated from such vapors. Separation of the entrained solids from the vapors in a cyclone separator separates a substantial amount of such solids but leaves remaining up to about two percent of solids generally of a size less than, or equal to, about two microns. The entrained solids can be unremoved solid source of heat particles used in the pyrolysis zone, inorganic particulates that are not removed by air classification, solids left behind by volatilizing material quickly, and solids formed from the vapor state by decomposition of vapors.

The pyrolysis vapors leaving the cyclone separators are quenched with a suitable immiscible fluid which for solid municipal wastes can be a No. 2 fuel oil. With reference to the drawing, the pyrolysis vapor stream 1 is introduced to a quench tower 3 wherein the hot pyro sis vapor is quenched with a No. 2 fuel oil. The result quenched vapor and liquid mixture is introduced t decanter 7 wherein the noncondensables are separa for later cooling. The liquids produced in the decan 7 are separated into a heavy pyrolytic oil fraction h ing a specific gravity greater than 1.2 and a ligh liquid fraction having a specific gravity less than 1 which lighter fraction is comprised of substantia quench fluid. This lighter fluid fraction can be recycl and combined with the quench fluid for use in quen ing additional pyrolysis vapor in the quench tower Generally, the decanter 7 is operated at a temperat of about 185° F.

The heavy pyrolytic oil fraction, having a speci gravity greater than 1.2 and containing entrained so particulate matter, is fed to a centrifuge 21. The py lytic oil is centrifuged into three components by t centrifuge. The centrifuge is held at a temperature about 150° F.

The heavy fraction separated in the centrifuge has analysis of about 54.4 percent carbon, 4.63 percent h drogen and 6.5 percent ash. The heavy fraction is gritty and sludge-like material which generally rep sents about four percent of the pyrolytic oil by weig It is apparent that this heavy fraction contains entrain solid particulate matter originally present in the py lytic oil fed to the centrifuge.

The middle fraction has an analysis of about 3 percent of carbon, about 7.41 percent hydrogen a about 0.5 percent ash. The middle fraction is a relative thin and watery-like fraction which amounts to about percent of the pyrolytic oil by weight. The low a content of the middle fraction illustrates that the mid fraction has a substantially reduced solids content th the initial pyrolysis oil fed to the centrifuge. That is, t middle fraction is substantially solids free.

The least dense fraction or light fraction produced the centrifuge has an analysis of about 59.75 perce carbon, about 10.39 percent hydrogen. This light fra tion contains some solid particulate matter. The lig fraction is relatively thick and has a consistency simil to mayonnaise. The lighter fraction comprises about percent of the pyrolytic oil by weight. The light fra tion recovered from the centrifuge 27 contains residu quench liquid. The quench liquid is separated from t light fraction in decanter 29. The reclaimed and sep rated quench liquid can be recycled to the quen tower 3. The separated light fraction is pumped throu pump 33 to mixer 37.

The middle fraction separated in the centrifuge comprises a useful carbonaceous product having a lo solids content.

The heavy fraction is introduced to an extruder which disperses agglomerative material within t heavy sludge-like fraction. After leaving the extrud 35, the heavy fraction is thinned using the liquid lig fraction from decanter 29 and liquid thinning solve from condenser 13 which comprises additional liqu values condensed from a portion of the initial pyroly vapor. That is, noncondensable material which does n condense in the quench tower 3 is recovered from d canter 7 and condensed in a series of condensers. F example, a first condenser 11 generally at a temperatu of about 145° to 155° F. produces a condensate which about 80 percent water. This water is considered fo water containing little carbonaceous products of valu The vapor stream from the first condenser 11 passes second condenser 13 generally at a temperature of ɔout 95° to 105° F. The liquid material produced in ıch a second condenser can be used as a thinning sol- ɜnt for adding to the heavy fraction produced from the ɜntrifuge and after passing through extruder 35. The ɔncondensable material leaving the second condenser 3 passes through demister 15 wherein entrained liquid separated and combined with the liquid available for ıinning the heavy fraction. The separated vapor is a ıs product or a carrier gas used in the pyrolysis pro- ɜss, such as an inert gas.

Additionally, the heavy fraction after passing ırough the extruder can be thinned with liquid that is ɜcycled from the distillation column 45. The thinning f the heavy sludge-like fraction allows reclaiming ad- tional fuel values and assists in filtration of the heavy action in filter 39. All of the thinning liquids are mixed ith the heavy fraction in the mixer 37. The mixer 37 is ɜnerally maintained at a temperature of about 120° F. rom the mixer 37 the mixture of material is fed to a lter 39. For example, such filter can be a rotary filter. enerally, such filter is maintained at a temperature of ɔout 140° F. The solids are collected from the filter 39 ɔr use as char or for use in recycling to the pyrolysis ɔne. The filtrate recovered from the filter 39 is frac- ɔnated in distillation column 45. Fractionation of the ltration produces light organics, i.e., boiling up to ɔout 160° F., a thin recycle fraction having a boiling nt up to about 190° F. which recycled product is ɜcycled through condenser 53. The bulk of the mate- al recovered from the distillation column, i.e., remain- g in liquid state at temperatures above about 190° F. is ixed with the middle fraction from the centrifuge 21 in ixer 59.

Of the total condensables present in the pyrolysis ıpor, about 80.2 percent is liquid product, 15.0 percent foul water and 2.8 percent is low flash point organics, ıd about 2 percent is char solids, which constitute ɔout a 40 percent ash content. The liquid product has ı analysis of about 70 percent water content and about 5 percent ash. The liquid product produced provides substantially solids free product which can be used for ; fuel value or its chemical values which can be recov- ed through subsequent chemical processes.

What is claimed is:

1. A process for producing organic liquid product om municipal, industrial, agricultural and sanitary aste containing organic solids, the process comprising e steps of:

(a) pyrolyzing a solid organic waste obtained from municipal, industrial, agricultural and sanitary waste containing organic solids in a substantially inert, oxygen-free atmosphere to produce pyrolysis vapor and a solid pyrolysis residue including fine particulate matter entrained in the pyrolysis vapor;

(b) separating the pyrolysis vapor containing entrained particulate matter from the solid pyrolysis residue;

(c) condensing at least a first portion of the separated pyrolysis vapor to produce pyrolysis liquid containing entrained particulate matter;

(d) centrifuging such pyrolysis liquid to produce a light fraction containing entrained particulate matter, a middle fraction substantially free of particulate matter, and a heavy fraction containing entrained particulate matter;

(e) recovering such middle fraction substantially free of particulate matter as organic liquid product;

(f) recovering such light fraction containing entrained particulate matter; and (g) recovering such heavy fraction containing entrained particulate matter.

2. A process as recited in claim 1 wherein the pyrolysis liquid is centrifuged in a first centrifuge to produce an intermediate fraction and said heavy fraction each containing entrained particulate matter; and said intermediate fraction is centrifuged in a second centrifuge to produce the light fraction containing entrained particulate matter and the middle fraction substantially free of entrained particulate matter.

3. A process as recited in claim 1 further comprising the step of condensing at least a second portion of the pyrolysis vapor to produce a thining solvent; and recovering noncondensable pyrolysis vapor as a gaseous product.

4. A process as recited in claim 1 wherein the light fraction containing entrained particulate matter recovered from the centrifuging step is separated into two liquid portions, a first liquid portion and a second liquid portion containing a relatively greater amount of entrained particulate matter than said first liquid portion.

5. A process as recited in claim 4 wherein the first liquid portion of the light fraction is mixed with the heavy fraction recovered from the centrifuging step.

6. A process as recited in claim 4 wherein the second liquid portion of the light fraction is recycled as a quench fluid for condensing pyrolysis vapor to produce pyrolysis liquid containing entrained particulate matter.

7. A process as recited in claim 1 further comprising the steps of forming a mixture of the light fraction containing entrained particulate matter with the heavy fraction containing entrained particulate matter, filtering the mixture to produce a liquid filtrate and a solid residue of entrained particulate matter, and recovering the liquid filtrate.

8. A process as recited in claim 7 further comprising the steps of condensing at least a second portion of the pyrolysis vapor to produce a thinning solvent; and forming a mixture of the thinning solvent with the light fraction and heavy fraction recovered from the centrifuging step prior to filtering the mixture.

9. A process as recited in claim 7 or 8 further comprising the steps of distilling the liquid filtrate into at least one lower boiling fraction and one higher boiling fraction; forming a mixture of such higher boiling fraction, the light fraction and the heavy fraction and filtering such mixture.

10. A process as recited in claim 9 wherein said lower boiling fraction has a boiling point of up to about 160° F. and wherein said higher boiling fraction has a boiling point of up to about 190° F.

11. A process as recited in claim 10 further comprising recoverying a fraction of liquid filtrate having a boiling point greater than about 190° F.

12. A process as recited in claim 11 wherein the recovered fraction of liquid filtrate having a boiling point greater than about 190° F. is mixed with said middle fraction substantially free of particulate matter to form an organic liquid product.

13. A process for producing an organic liquid product from solid organic waste, the process comprising the steps of:

(a) pyrolyzing a solid organic waste in a substantially inert, oxygen-free atmosphere to produce pyrolysis vapor containing entrained, fine particulate matter and solid pyrolysis residue;

(b) separating the pyrolysis vapor containing entrained particulate matter from the solid pyrolysis residue;

(c) condensing at least a first portion of the pyrolysis vapor to produce pyrolysis liquid containing entrained particulate matter;

(d) condensing at least a second portion of the pyrolysis vapor to produce a thinning solvent containing entrained particulate matter;

(e) centrifuging the pyrolysis liquid to produce a light fraction containing entrained particulate matter, a middle fraction substantially free of entrained particulate matter and a heavy fraction containing entrained particulate matter;

(f) recovering the middle fraction as organic liquid product substantially free of entrained particulate matter;

(g) recovering the light fraction containing entrained particulate matter and separating said light fraction into a first liquid portion and a second liquid portion containing a relatively greater amount of entrained particulate matter than said first liquid portion;

(h) recovering the heavy fraction containing entrained particulate matter;

(i) mixing the heavy fraction with the first liquid portion of the light fraction and thinning solvent to form a mixture containing entrained particulate matter;

(j) filtering the mixture to separate the entrained p ticulate matter therefrom and form a liquid filtr (k) distilling the liquid filtrate into a low boiling fr tion, an intermediate boiling fraction and a h boiling fraction;

(l) recovering the low boiling fraction;

(m) recovering the intermediate boiling fraction;

(n) recovering the high boiling fraction; and (o) mixing the recovered high boiling fraction middle fraction from the centrifuging step.

14. A process as recited in claim 13 further comp ing the step of recycling the second liquid portion of light fraction as a quench fluid to condense at least s first portion of the pyrolysis vapor.

15. A process as recited in claim 13 further comp ing the steps of forming a mixture of the intermedi boiling fraction produced by distilling the liquid filtra the heavy fraction, the first liquid portion of the li fraction and the thinning solvent and filtering the res tant mixture.

16. A process as recited in claim 13 wherein the fr tions produced upon distilling the liquid filtrate co prise a low boiling fraction having a boiling point up about 160° F., an intermediate boiling fraction havin boiling point up to about 190° F. and a high boili fraction having a boiling point greater than 190° F.

17. An organic liquid product produced from so organic waste by the process of claim 1.

* * * * *

UNITED STATES PATENT AND TRADEMARK OFFICE

CERTIFICATE OF CORRECTION

PATENT NO. : 4,260,473

DATED : April 7, 1981

INVENTOR(S) : Hans F. Bauer

It is certified that error appears in the above—identified patent and that said Letters Patent is hereby corrected as shown below:

IN THE SPECIFICATION:

Column 1, line 26, change "dilemna" to -- dilemma --;
line 65, change "in" to -- is --.

Column 4, line 8, change "Muncipal" to -- Municipal --;
line 20, change "proces" to -- process.

Column 5, line 19, change "of" to -- by --.

Column 10, line 10, delete "fluid" and insert -- liquid --.

Column 11, line 29, change "oint" to -- point --.

IN THE CLAIMS:

Column 11, line 60, after "produce" insert -- a --.

Column 12, line 55, change "recoverying" to -- recovering --.

Signed and Sealed this

*Fourth* Day of *August 1981*

[SEAL]

*Attest:*

GERALD J. MOSSINGHOFF

*Attesting Officer*

*Commissioner of Patents and Trademarks*